US005620633A

United States Patent [19]

Junkel et al.

[11] Patent Number: 5,620,633

[45] Date of Patent: Apr. 15, 1997

[54] SPRAY MISTING DEVICE FOR USE WITH A PORTABLE-SIZED FAN

[75] Inventors: Eric F. Junkel, Des Plaines; Linda M. Usher, Chicago, both of Ill.

[73] Assignee: Circulair, Inc., Niles, Ill.

[21] Appl. No.: 516,388

[22] Filed: Aug. 17, 1995

[51] Int. Cl.[6] ..... B01F 3/04

[52] U.S. Cl. ..... 261/28; 261/90; 239/600; 239/327; 239/375; 239/289

[58] Field of Search ..... 261/28, 84, 90; 239/600, 327, 355, 351, 77, 375, 289

[56] References Cited

U.S. PATENT DOCUMENTS

| | | | |
|---|---|---|---|
| D. 178,144 | 6/1956 | Miller . | |
| D. 220,246 | 3/1971 | Pacelli . | |
| D. 264,181 | 5/1982 | Booso . | |
| D. 292,556 | 11/1987 | Daugherty . | |
| D. 349,570 | 8/1994 | Radtke, Jr. . | |
| 2,351,226 | 6/1944 | Pemhall | 239/351 |
| 2,608,792 | 9/1952 | Chater | 239/77 |
| 2,736,606 | 2/1956 | Kmiotek | 239/351 |
| 2,787,501 | 4/1957 | Tuma | 239/289 |
| 2,937,712 | 5/1960 | Woods | 261/90 |
| 3,296,739 | 1/1967 | Wiegel | 239/77 |
| 3,659,791 | 5/1972 | Clark | 239/375 |
| 3,734,357 | 5/1973 | Batistelli et al. | 239/375 |
| 3,997,115 | 12/1976 | Licudine | 239/375 |
| 4,399,794 | 8/1983 | Gagnon | 261/84 |
| 4,523,080 | 6/1985 | Bolton . | |
| 4,700,494 | 10/1987 | Pridgen . | |
| 4,839,106 | 6/1989 | Steiner . | |
| 4,911,361 | 3/1990 | Tada | 239/600 |
| 5,338,495 | 8/1994 | Steiner et al. . | |

*Primary Examiner*—Tim R. Miles

*Attorney, Agent, or Firm*—Gifford, Krass, Groh, Sprinkle, Patmore, Anderson & Citkowski, P.C.

[57] ABSTRACT

A portable misting device and fan for use by sunbathers and those engaged in athletic pursuits. The fan encloses a fan blade unit and the misting device includes a body which contains a volume of a liquid and which is mounted to a rear of the fan by a mounting bracket. A spray applicator extends from the body and is in a direction above and toward a front of said fan blade unit. The spray applicator is actuable to withdraw fluid from within the misting device body and to supply it as an atomized spray in front of the fan blade unit. The fan blade unit cools and distributes the spray in a direction chosen by the user.

18 Claims, 7 Drawing Sheets

SPRAY MISTING DEVICE FOR USE WITH A PORTABLE-SIZED FAN

BACKGROUND OF THE INVENTION

1. Field of the Invention

The present invention relates generally to misting devices and, more specifically, to a portable spray misting device for use with a portable fan for producing a cooling atomized mist spray, 2. Description of the Prior Art Portable cooling and misting devices which are used by sunbathers and others involved in athletic activities are fairly well known in the art. The concept of such devices is to provide a cooling current of air, either alone or in combination with an atomized liquid mist, such as water, to combat the elements of heat and dehydration attendant with athletic activities and/or prolonged exposure to the sun.

The prior art discloses a portable electric powered fan which is capable of being easily carried on a person and which is battery powered for delivering a cooling stream of air at any remote location without the need for cords or electrical outlets. The shortcoming of the prior art device is that it does not disclose a misting and/or fluid atomizing means for providing additional cooling relief to a user.

The prior art further teaches a portable misting fan device having an integral portable fan and atomizing head unit which includes electric power means for operating the fan unit and which forms a portable cooling unit. The head unit is attached by a screw-type connector to a standard fluid spray bottle. A trigger is positioned upon the head unit and, upon depressing, withdraws fluid from the bottle through a stem extending downwardly from the head unit into the bottle and discharges the fluid against the rear lower faces of the fan blade unit where they are subsequently dispersed in a mostly forward direction.

While providing a useful fan spray device, the prior art misting fan suffers from the shortcoming that it cannot be carried and used separately from the spray bottle base as a fan unit when it is desired to not employ the misting device. The unit is also quite bulky and requires the user to carry around more liquid than is reasonably needed for a single occasion. This is so because the relative size and weight of the head unit in the prior art device requires that the bottle be of at least a minimum size and the use of either a smaller bottle or a less than adequately filled bottle would result in instability of the design. The design of the spray outlet in the prior art device directs much of the delivered fluid to the back of the fan blades and invariably results in fluid dripping from the fan blades and centrifugal distribution of the water in a radial direction. Finally, the prior art device lacks an ergonomic grip for comfortably holding and carrying the device.

SUMMARY OF THE PRESENT INVENTION

The present invention is a spray misting device for use with a portable-sized fan for creating a cooling atomized mist spray. The fan is typically a battery powered stand alone device for convenience and portability and is shaped with a predetermined outline and thickness having a front and a rear and enclosing a fan blade unit between a front grille and a rear grille. The spray misting device includes a body of a given dimension having a hollow interior capable of holding a predetermined volume of a liquid and an applicator for providing an atomized mist spray of the liquid. A mounting clip assembly releasably secures the body to the rear of the fan unit so that the applicator is located in proximity to the fan blade unit. The applicator generates an atomized mist spray which is delivered from above and in a direction towards the front of the fan blade unit which creates a current of air to cool the mist spray and to deliver it to a user thereof. The device can be used as a combination fan and misting device or as either a misting device or fan separably as is desired by the user.

BRIEF DESCRIPTION OF THE DRAWING

Reference will now be made to the attached drawing, when read in combination with the following specification, wherein like reference numerals refer to like parts throughout the several views, and in which.

Figure 7:
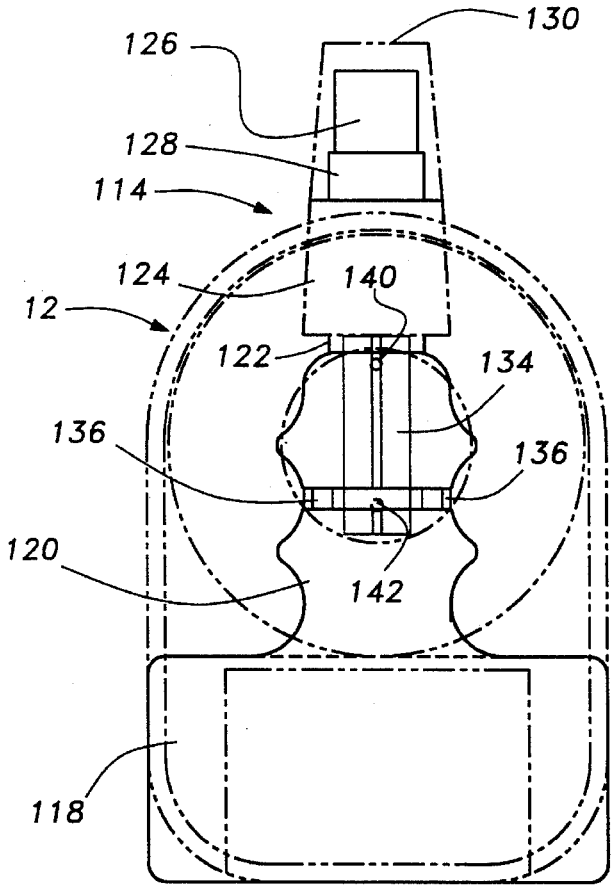
Figure 8:
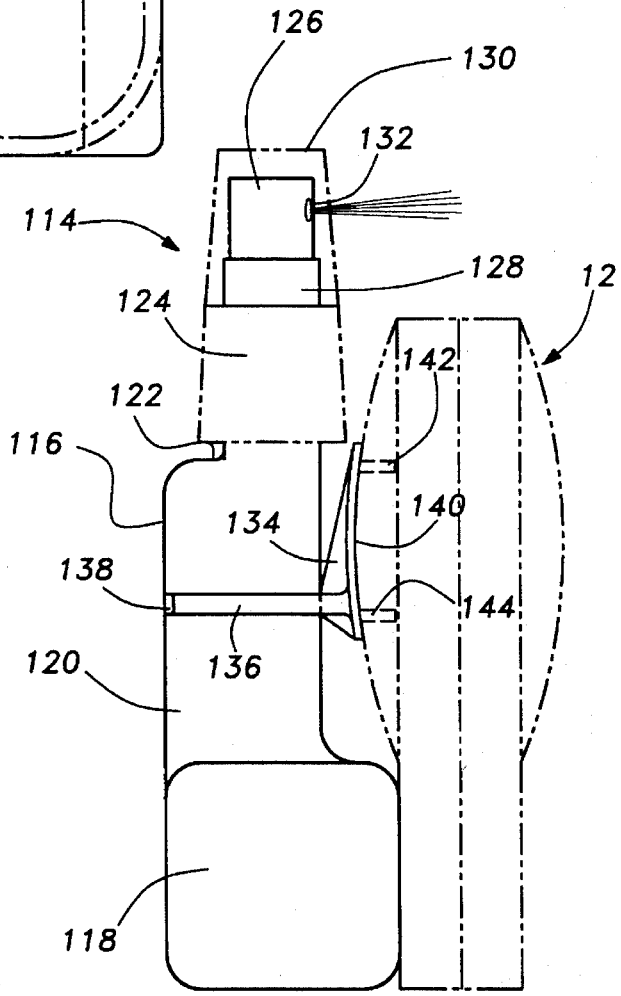
Figure 9:
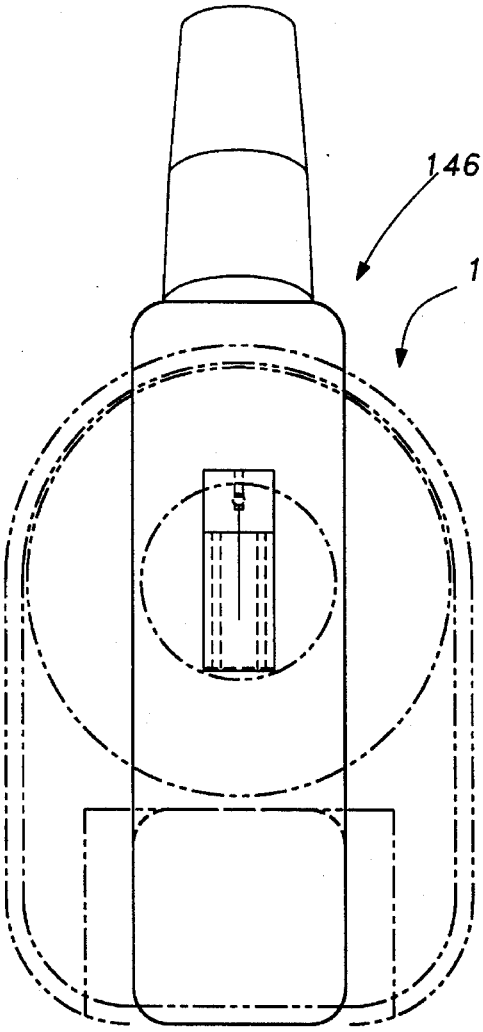
Figure 11:
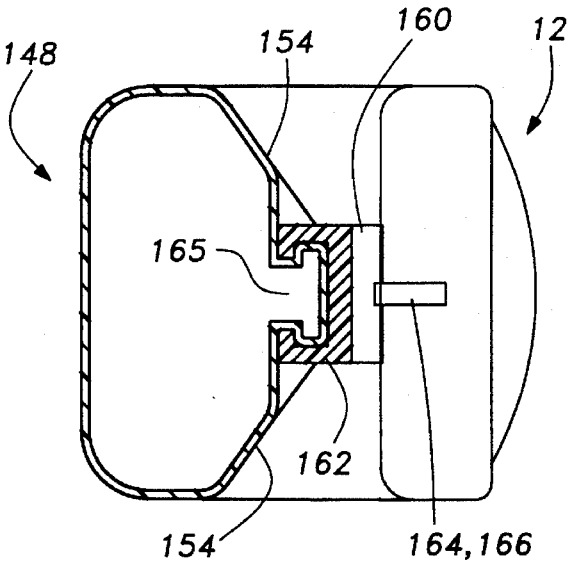
Figure 10:
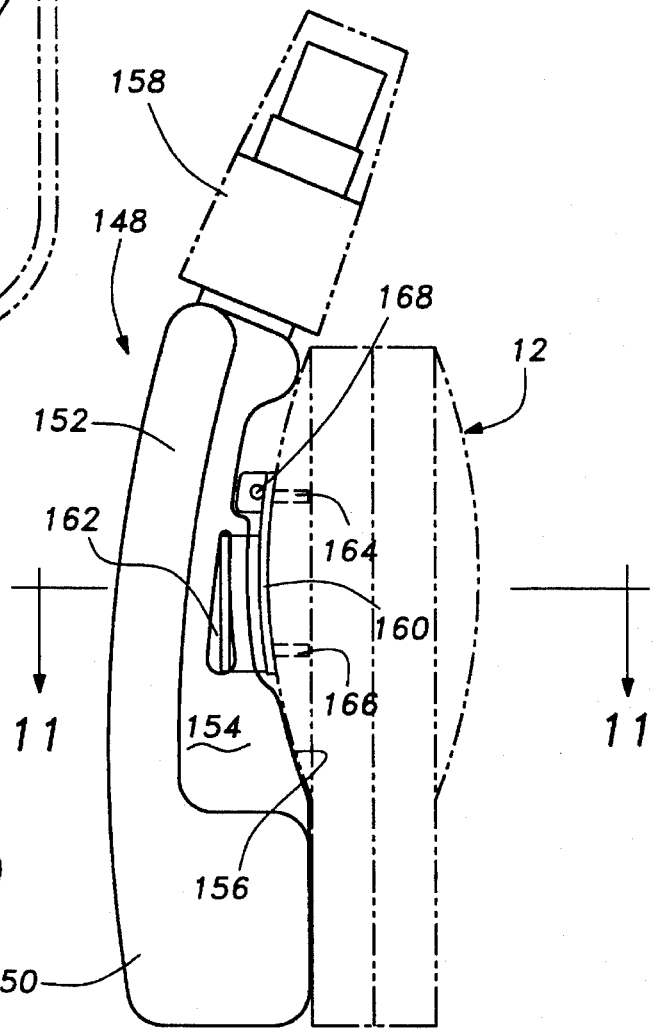
Figure 12:
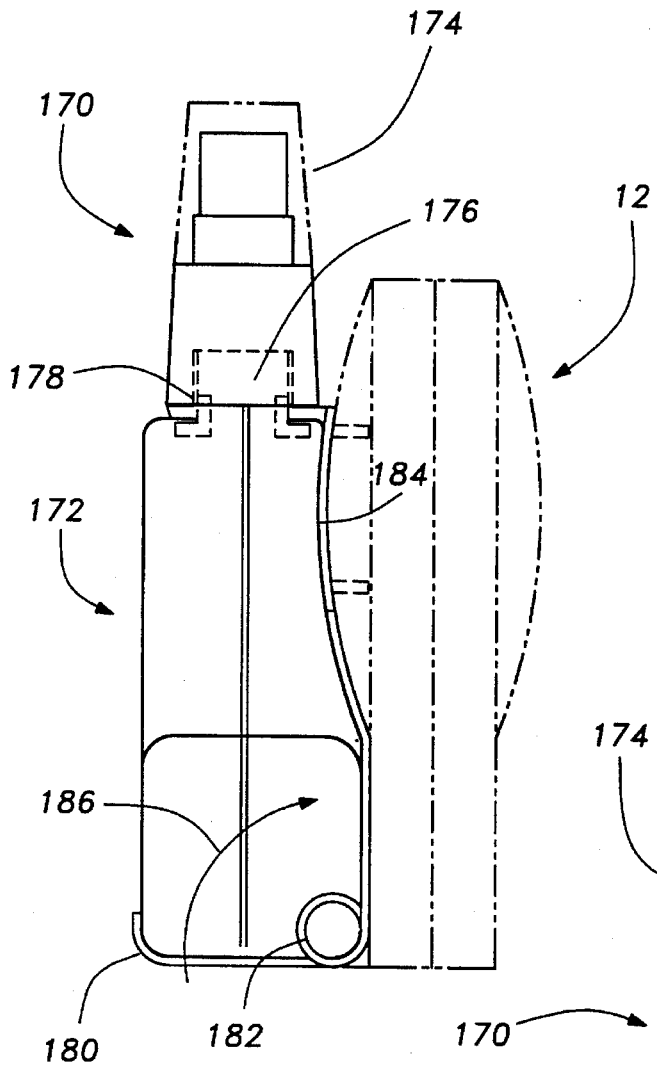
Figure 13:
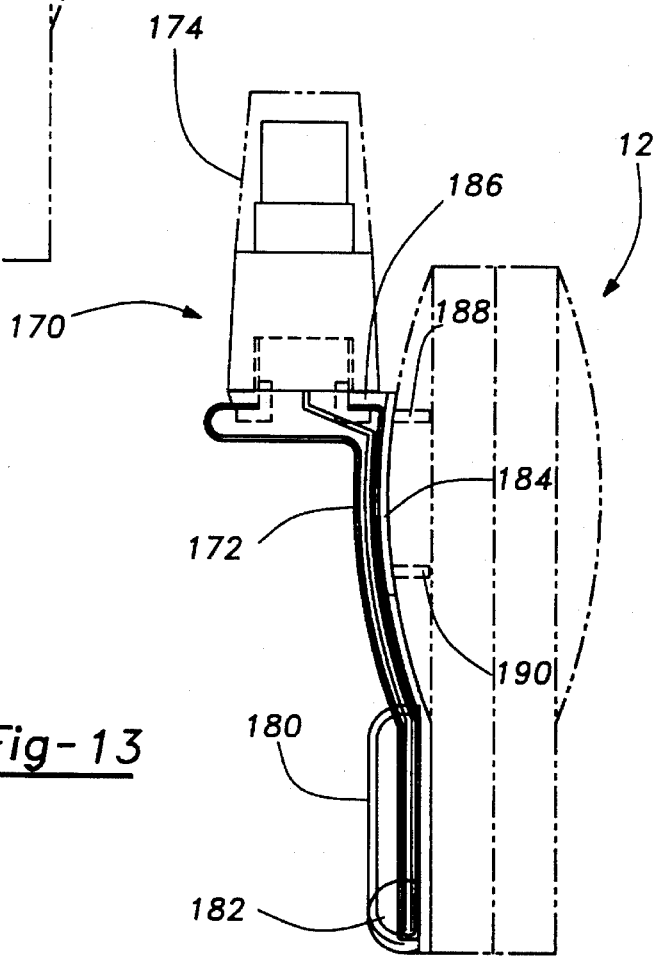
Figure 14:
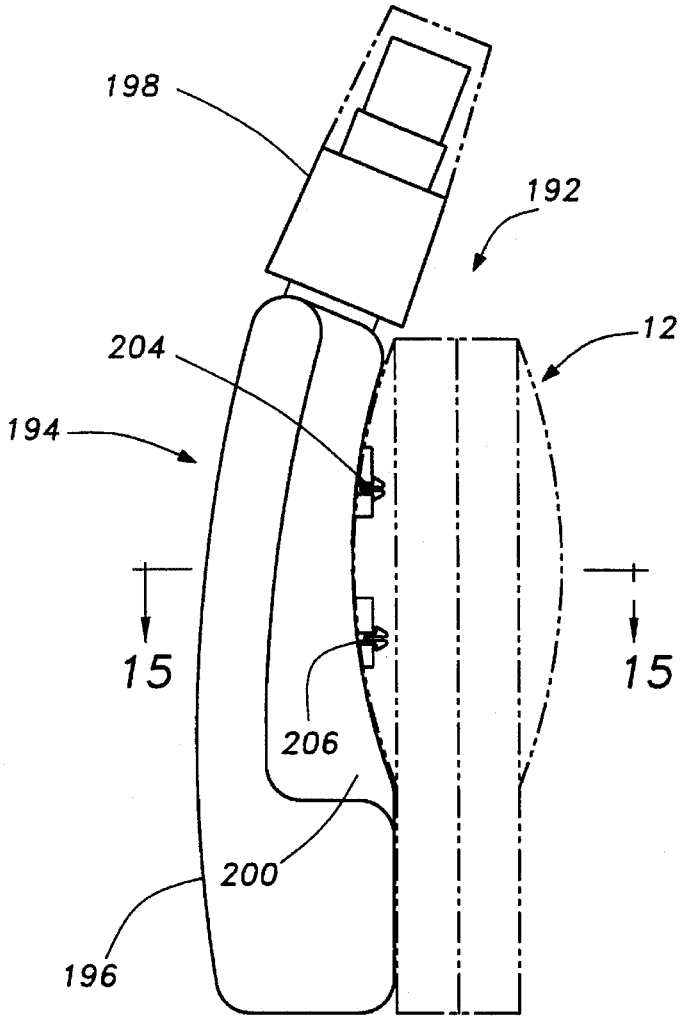
Figure 15:
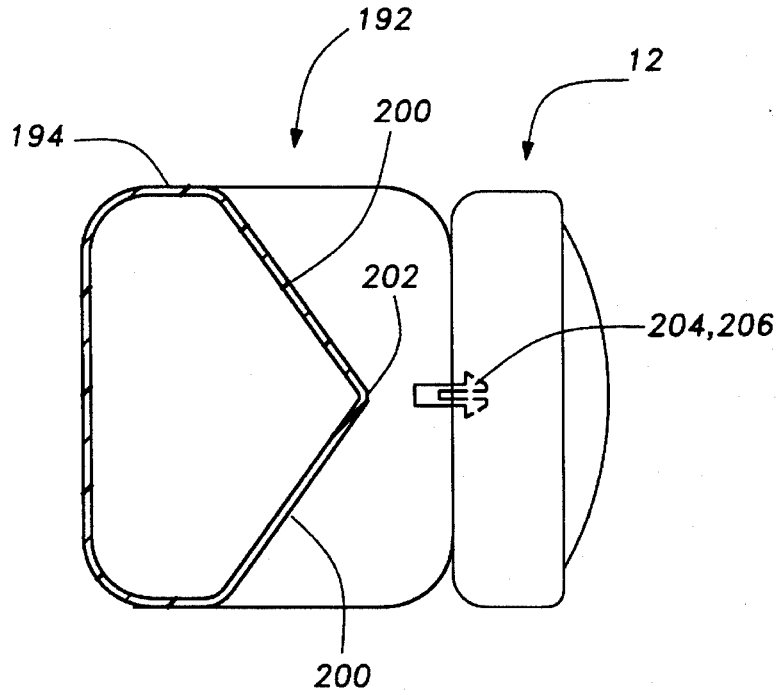

FIG. **6*a*** is a sectional view of an alternate spray applicator according to the present invention;

FIG. 7 is a frontal view of the spray misting device and portable fan according to a fourth preferred embodiment of the present invention;

FIG. 8 is a side view of the preferred embodiment shown in FIG. 7;

FIG. 9 is a frontal view of the spray misting device and portable fan according to a fifth preferred embodiment of the present invention;

FIG. 10 is a side view of the preferred embodiment shown in FIG. 9;

FIG. 11 is a cutaway view taken along line 11—11 of FIG. 10 and showing a cross sectional outline of the portable misting device and fan according to the fifth preferred embodiment of the present invention;

FIG. 12 is a frontal view of the spray misting device and portable fan according to a sixth preferred embodiment of the present invention;

FIG. 13 is a side view of the preferred embodiment shown in FIG. 12;

FIG. 14 is a side view of a spray misting device and portable fan according to a seventh preferred embodiment of the present invention; and FIG. 15 is a cutaway view taken along line 14—14 of FIG. 14 and showing a cross-section of the mounting means on the body for securing to the fan.

DESCRIPTION OF THE PREFERRED EMBODIMENTS

Figure 1:
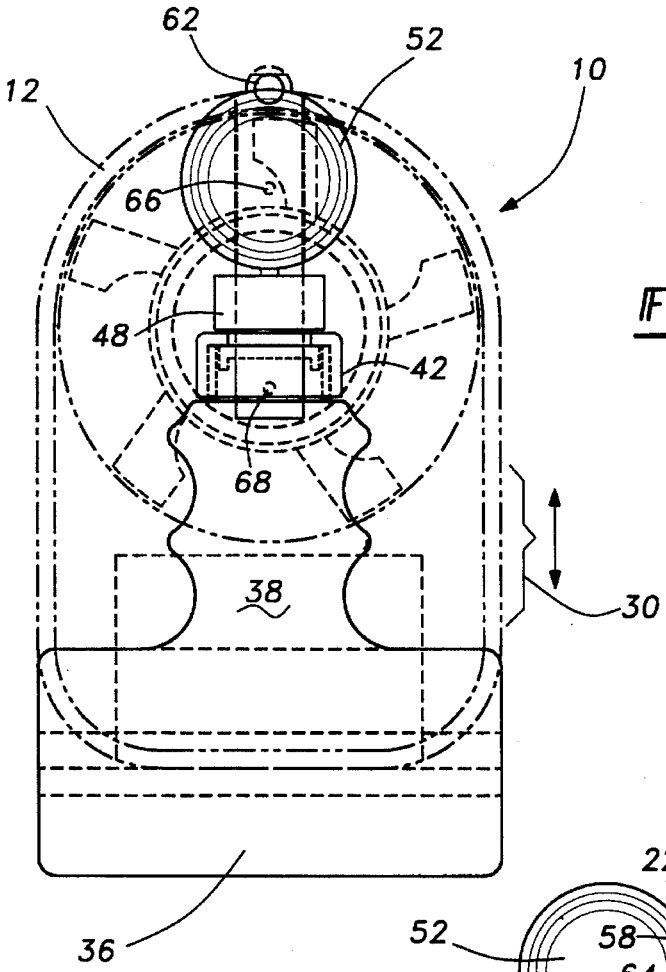
FIG. 1 is a frontal view of the spray misting device and portable fan according to a first preferred embodiment of the present invention.
Figure 2:
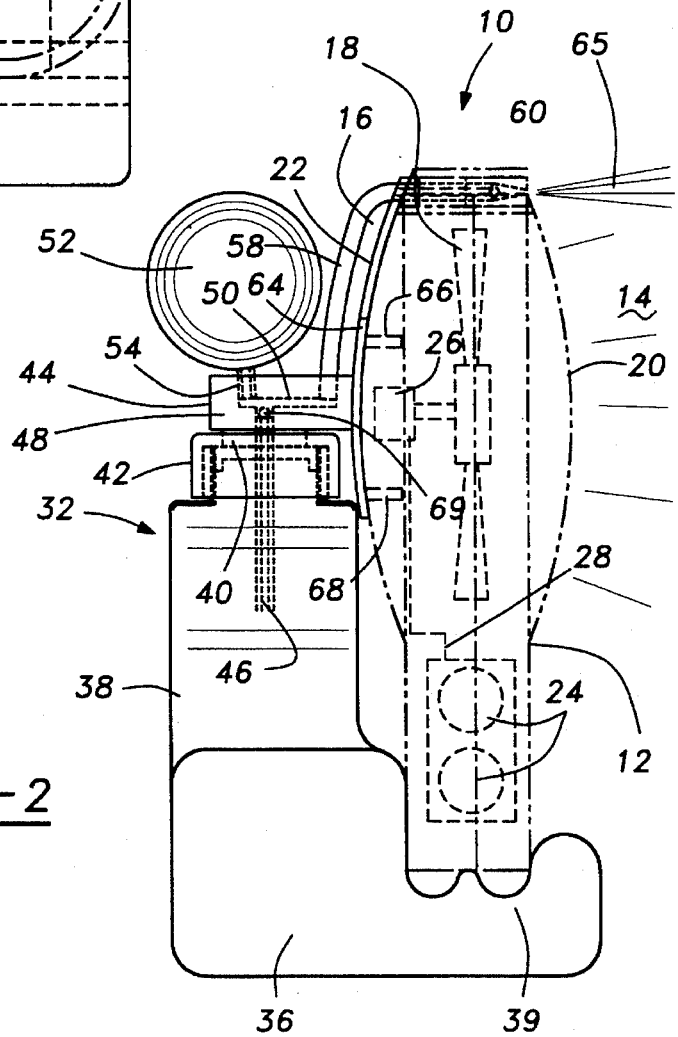
FIG. 2 is a side view of the preferred embodiment shown in FIG. 1.

Referring to FIGS. 1 and 2, a combination spray misting device and portable fan 10 is shown according to a first preferred embodiment of the present invention. As can be readily seen from FIG. 1, a fan 12 of the combination is shown and is constructed of a generally rectangular shaped outline. The fan body 12 can however be shaped in any manner desired and, according to FIG. 2, includes a front 14, a rear 16 separated from the front by a predetermined thickness and a fan blade unit 18 housed between a front grille 20 and a rear grille 22 of the fan body 12. As is conventionally known, the fan blade unit 18 draws air in through the rear grille 22 and expels the air in an accelerated stream through the front grille 22. A portable battery supply, such as a pair of AA volt batteries 24 are connected to a small electric motor 26 of conventional design by an actuated line 28. Alternatively, an A/C adapter jack may attach to an input plug in the portable fan (not shown) for providing power to the fan. An on/off button 30 (see FIG. 1) is activated to close a circuit established between the battery supply and the motor and causes the motor to operate the fan blade unit.

A spray misting device 32 includes a body having an outline with a supporting base 36, a narrowed and contoured midsection 38 and an outlet 40. The base 36 of the misting device 32 may be shaped at a forward end thereof 39 to receive and support the portable fan 12 thereupon so as to give the body of the device a generally L-shape as seen from the cross section of FIG. 2. The midsection 38, as seen from FIG. 1, is contoured in a grip design to facilitate handling by a user. The device 32 is further constructed of a durable plastic or like material that can be easily and inexpensively fabricated and has a hollow interior capable of holding a predetermined volume of a liquid, such as water. A screw cap 42 attaches over the outlet 40 and may be selectively screwed or unscrewed to the spray device when it is desirable to add more water to the device 32. The ergonomic shape of the midsection 38 in combination with the enlarged base 36 of the body facilitates ease of carrying and handling by a user of the device while still providing adequate fluid carrying capability.

An applicator 44 is mounted to the outlet 40 of the body for generating a misting and atomized spray of the fluid contained in the body. The applicator 44 includes a stem 46 which extends through a central aperture in the screw cap, past the outlet, and down into the interior of the misting body. An applicator body 48 is integrally mounted with the screw cap 42 and includes an internal channel 50 which fluidly connects to the stem 46. A spray ball 52 extends from the applicator body 48 and is connected to the internal channel 50 by an input 54. The spray ball 52 is of a type conventionally known and used with perfume sprays and the like and has a hollowed interior which, upon squeezing of the ball, expels fluid through nozzle 60 and upon release creates a vacuum in the stem 46 to draw fluid upwardly from the misting container. The spray ball may also be constructed of a hemispherical diaphragm (not shown). A flexible outlet tube 58 is connected to the internal channel 50 at an end opposite the input 54 and extends upwardly and forwardly of the applicator in a direction towards the fan. The outlet tube terminates in the nozzle portion 60 which is mounted within an aperture 62 (see FIG. 1) at a top center position of the fan body 12 at the rear 16 of the fan.

A mounting bracket 64 is provided for releasably securing the misting device 32 to the rear face 16 of the fan. The bracket is substantially arcuate shaped along a forward face thereof and is integrally formed to extend from a forward edge of the applicator body 48. An upper mounting prong 66 and a lower mounting prong 68 extend forwardly from the arcuately shaped bracket and are received in a pair of corresponding upper and lower apertures formed in the rear of the fan body to releasably affix the misting device to the fan. The upper and lower prongs are sized to provide a satisfactory snap fit within the fan apertures. While the preferred embodiment of FIGS. 1 and 2 show a mounting bracket for securing the misting device to the fan, it is understood that any alternative type of structure can be used in place of the mounting bracket for releasably securing the misting unit in place. Although the mounting bracket is shown as having an arc shape, it can also be provided as a flat shaped bracket to correspond to a flat mounting surface on the fan body, such as the outside of the motor enclosure on the rear face which is usually flattened but cannot be seen from the drawings.

In use, the misting device is mounted to the fan body as previously described, the device having been prefilled with a desired fluid such as water and the screw cap tightened in place. The portable fan may or may not be operating prior to engaging the misting device but, in the preferred embodiment, is activated to the on position. The squeeze ball 52 is then depressed and released in order to expel a measured volume of fluid from the reservoir within the misting device, through the stem 46, the internal channel 50 in the applicator body, the outlet tube 58, and into the nozzle 60 positioned atop the fan body. The nozzle is constructed so that the fluid is discharged as a finely atomized spray, as seen as 65 in FIG. 2, in a direction from above and in front of the front grille 20 of the fan. As a result of gravity, the spray 64 will descend downwardly in front of an accelerated current of air generated by the fan and will be cooled by evaporation and subsequently dispersed outwardly in a direction chosen by the user. When released, the vacuum created by the pump ball draws fluid up through the stem out of the reservoir. A small ball bearing 69 acts as a check valve to keep fluid from flowing back into the reservoir or air from getting sucked into the pump body.

The squeeze ball may be pumped repetitiously to withdraw measured volumes of fluid which are subsequently atomized and cooled by the fan for application to the user. In this manner, the user may determine the amount of spray mist to be applied. The nozzle may also be designed so it may be withdrawn from within the aperture in the fan and the misting device separated from the fan by the mounting bracket so that it may be separately used purely as a misting device. As was previously described, the fan may also be used separately or in combination with the misting device.

Having described in detail the operation of the device according to the first preferred embodiment, a description will now be made of the second, third, fourth and fifth preferred embodiments. It is understood that the design and operation of the fan remains unchanged in the several embodiments, therefore the features of the fan will not be repeated except as necessary to complement the features of the misting device of the present invention. A detailed description of the further preferred embodiments will now be made.

Figure 3:
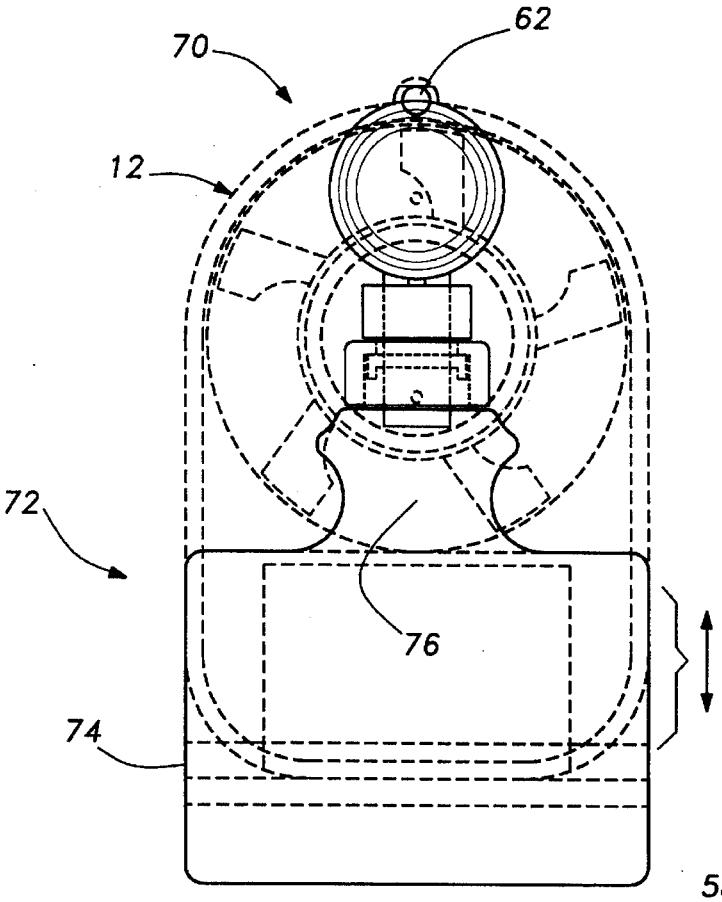
FIG. 3 is a frontal view of the spray misting device and portable fan according to a second preferred embodiment of the present invention.
Figure 4:
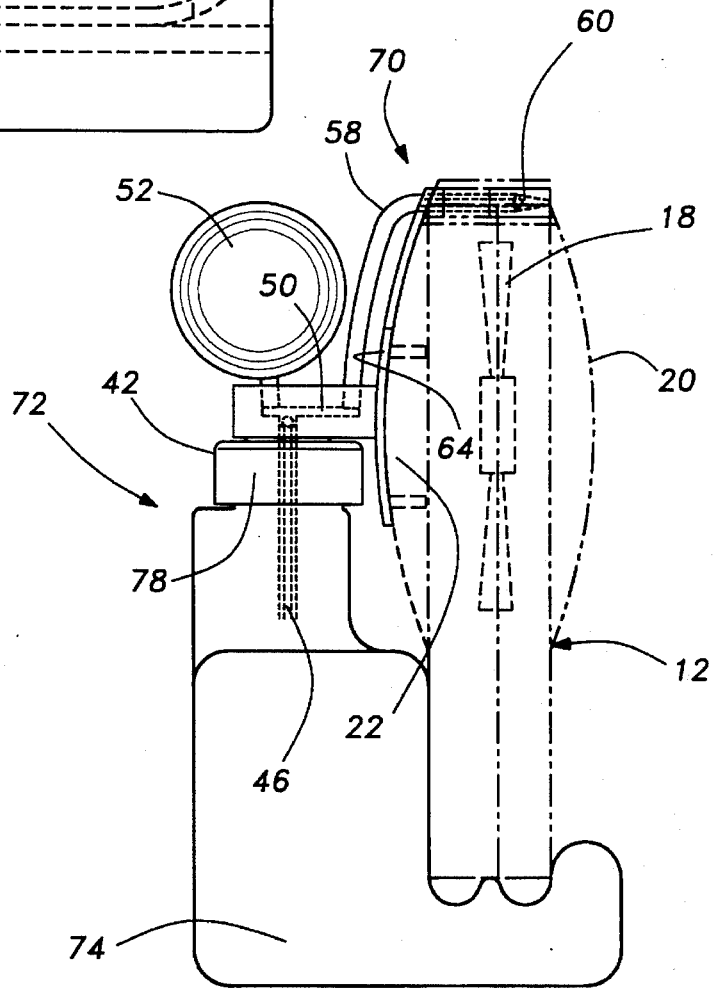
FIG. 4 is a side view of the preferred embodiment shown in FIG. 3.

Referring to FIGS. 3 and 4, a combination spray misting device and portable fan 70 according to a second preferred embodiment is shown. The misting device and fan according to the second preferred embodiment is identical in every respect to that of the first preferred embodiment, with the exception of the shaping of the body of the of a misting device 72. The device 72 includes a base 74 and a contoured midsection 76 which extends upwardly from the base and which terminates in an outlet 78. The base 74 of the second preferred embodiment 70 is larger in a vertical dimension relative to the base 36 of the first preferred embodiment 10, the midsection 76 being of a correspondingly smaller dimension with fewer ergonomically shaped grooves to compensate for the enlarged base 74. The body of the misting device according to the second preferred embodiment is intended to provide for additional fluid holding capacity above that permitted by the body of the first preferred embodiment while still providing an ergonomically usable device which may be easily gripped and operated by a user. The combination misting device and fan 70 otherwise operates in an identical fashion to that disclosed in the first embodiment.

Figure 5:
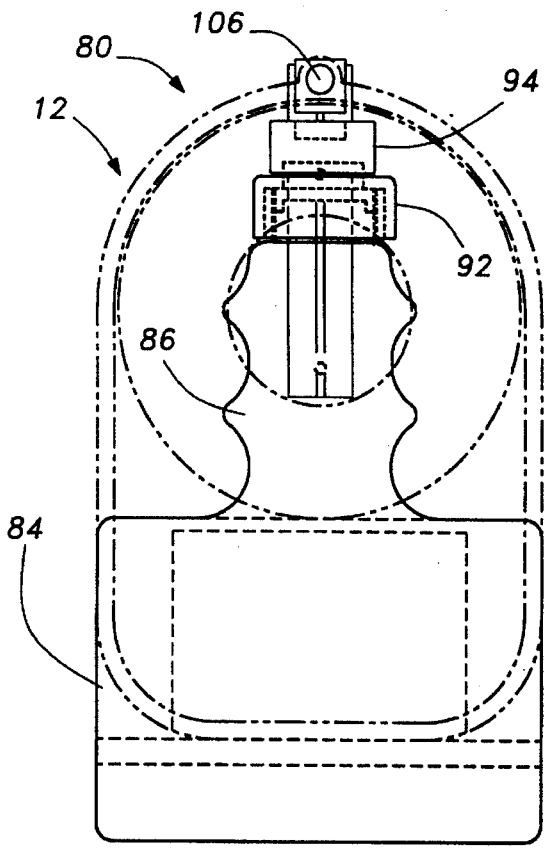
FIG. 5 is a frontal view of the spray misting device and portable fan according to a third preferred embodiment of the present invention.
Figure 6A:
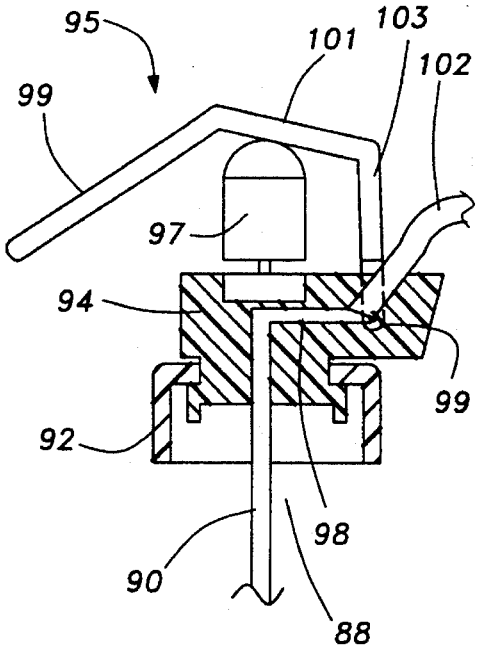
FIG. 6 is a side view of the preferred embodiment shown in FIG. 5.
Figure 6:
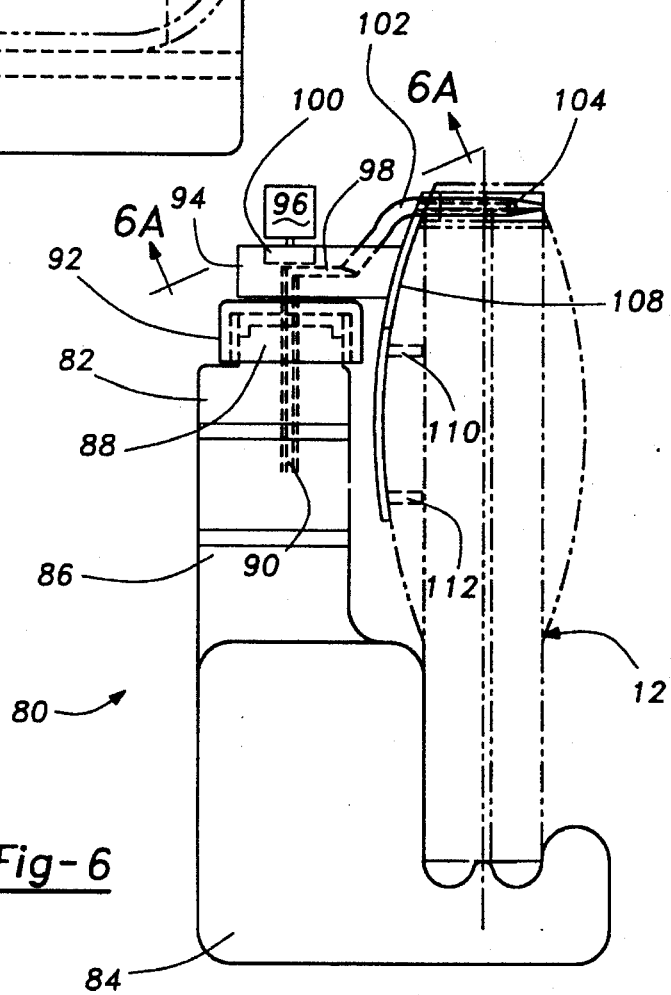

Referring to FIGS. 5 and 6, a combination spray misting device and portable fan 80 is shown according to a third preferred embodiment. A body 82 of the misting device is shaped similarly to the corresponding misting devices of the first and second preferred embodiments and includes a base 84 and a contoured midsection 86 which terminates in an outlet 88. The base 84 is approximate in dimension to the base 74 of the second preferred embodiment, however the midsection 86 is larger than in either the first and second embodiments so that the misting device body has a substantially greater height relative to the fan 12.

Referring specifically to FIG. 6, a stem 90 extends upwardly from within the interior of the misting device body, through the outlet 88 and a screw cap 92 attached over the outlet, and into an applicator body 94 which is integrally formed with the screw cap 92. A piston pump head 96 extends from the applicator body 94 and is fluidly connected to an internal channel 98 formed in the applicator body by a shaft portion connected to an input 100 of the applicator body. The internal channel 98 is fluidly connected at an opposite end to an outlet tube 102 similar to that disclosed in the first and second preferred embodiments. The outlet tube 102 terminates in a nozzle 104 which is mounted within an aperture 106 (see FIG. 5) facing forwardly at a top central point in the front of the fan body. The pump head 96 is similar in respects to the spray ball 52 of the first and second embodiments and, upon being depressed in a direction toward the applicator body, will create a pumping action to withdraw fluid from the receptacle. The pump head is repetitively depressed to withdraw measured volumes of fluid from within the receptacle and issue the fluid as a misted and atomized spray from the nozzle. The construction and operation of the applicators is submitted to incorporate technologies known in the art for withdrawing and issuing fluid and it is submitted that no additional disclosure regarding their operation is necessary.

Referring to FIG. 6*a*, a trigger arm 95 may alternatively be used for actuating a spray pump applicating head 97. The spray pump head 97 is similar to the head 96 shown in FIG. 6, with the exception that it has a rounded upper surface for being contacted and depressed downwardly by the trigger arm 95. The trigger arm 95 is hingedly connected to the applicator body 94 and includes first and second angled portions 99 and 101 and a downwardly extending portion 103 which terminates in the hinged connection 99. In use, the angled portion 99 is depressed downwardly so that the portion 101 biases downwardly against the spray head to cause the spray head to issue the atomized mist spray.

Referring again to FIGS. 5 and 6, a mounting bracket 108 is provided for releasably securing the misting device to the fan. The bracket 108 is similar in regards to the bracket shown in the earlier preferred embodiments, with the exception that it is larger in cross section and extends from the applicator body at a higher point relative to the rear of the fan. An upper mounting prong 110 and a lower mounting prong 112 extend from the mounting bracket and are secured within their associated recesses in the rear face of the fan as previously described to mount the fan to the misting device.

Referring to FIGS. 7 and 8, a combination spray misting device and portable fan 114 is shown according to a fourth preferred embodiment of the present invention. A body 116 of the misting device includes a base 118 which, similarly to the first, second and third preferred embodiments, has a width approximate to that of the fan body and which provides added stability to the fan body. A contoured an upwardly extending middle 120 extends from the base (see contours in FIG. 7) and terminates in a neck portion 122. As with the previous embodiments, the body of the misting device holds a predetermined volume of fluid. An applicator body 124 is threadably attached to the open neck of the misting body as is conventionally known and terminates in a spray pump head 126 which is connected to the applicator body 124 through an intermediate portion 128. A cap 130 is attached over the pump head 126 for when the device is not in use.

The design and construction of the spray pump head 126 is well known in the art and, upon being depressed relative to the intermediate portion 128, causes fluid to be withdrawn from the within the misting body through a stem extending downwardly into the receptacle body (not shown in this embodiment) and issued as an atomized mist spray from an opening 132 in the pump head. The pump head is positioned above and behind the fan blade unit of the fan and the resultant spray travel over the fan and descends in front for cooling and dispersal by the air currents generated by the fan blade unit as previously described. The spray applicating means of the fourth preferred embodiment, as with embodiments one through three, provides for more efficient and thorough spray distribution in combination with the fan and permits a user to derive the same level of cooling comfort with lesser volumes of fluid than is required with prior art misting devices.

A mounting bracket 134 is provided for releasably securing the misting device 116 to the fan 12. The bracket 134 includes a pair of rearwardly extending clip portions 136 which insert within associated grooves 138 formed in the sides of the contoured middle portion 120 of the misting device body. The bracket is arcuately shaped along a front face 140 thereof to correspond with and abut against the rear of the fan body. An upper prong 142 and a lower prong 144 extend forwardly from the bracket as described in the previous embodiments and insert within associated apertures formed in the rear face of the fan to releasably mount the fan to the misting device.

Referring to FIGS. 9–11, a combination spray misting device and portable fan 146 is shown according to a fifth preferred embodiment of the present invention. A body 148 of the misting device is similar in respects to the body 116 disclosed in FIGS. 7 and 8 and includes a base 150 and an upwardly extending midsection 152. The midsection 152 is inwardly recessed in a forward direction on both sides 154 so that the misting body is easier to grip by the user. The body 148 is contoured in a generally arcuate manner so that a forward surface 156 of the body is contoured to match the rear surface of the portable fan and so that a spray pump head 158 is tilted forwardly and downwardly to a point directly in front of the fan blade unit. The spray pump head 158 is successively depressed to issue the atomized mist spray in a direction downwardly and directly in front of the fan blade unit and does not rely upon the effects of gravity as in the embodiment of FIGS. 7 and 8 to position the spray in front of the fan unit.

A mounting bracket 160 is provided for mounting the misting device to the fan and includes a spring clip 162 which attaches within an associated recess in the recessed sides 154 of the body midsection. The spring clip 162 is attached to the mounting bracket 160 in a press fit manner and the bracket 160 in turn has the forwardly extending prongs 164 and 166 which secure within the associated recesses in the fan. Referring to the cutaway view of FIG. 11, the spring clip 162 has a generally U-shape in cross section and fastens about a generally T-shaped forward protrusion 165 of the body. Also, the contour of the sides 154 allows greater airflow through the rear and front grilles of the fan body.

Referring again to FIG. 10, a recess 168 is formed in an upper portion of the mounting bracket and may receive a lanyard or other string or rope for securing the combination misting device and fan about the neck of the user. While evident only from the embodiment of FIGS. 9–11, a lanyard loop may also be formed through either the mounting brackets or any other part of the combination misting device or fan for receiving a string or rope for suspending the device around the neck of a user.

Referring to FIGS. 12 and 13, a combination misting device and portable fan 170 is shown according to a sixth preferred embodiment. The misting device includes a body 172 of a substantially uniform shape and cross section and a spray pump head 174 of a type previously described which is mounted atop an outlet 176 of the body 172 and is held in place above a sealing collar 178. The body 172 of the sixth preferred embodiment differs from the earlier embodiments in that it is constructed of a flexible and soft waterproof material which will successively collapse as the fluid carrying reservoir within body is used up.

A reservoir support 180 forms an integral part of a mounting bracket 184 extends along the rear face of the portable fan 12 and supports a bottom surface of the flexible body to prevent the fluid filled reservoir from swinging back and forth while in use. The reservoir support 180 is secured to the mounting bracket by a circular spring element 182 which biasingly encourages the support 180 in a clockwise rotational direction 186 as indicated in FIG. 12 as the reservoir is emptied.

Referring again to FIG. 13, the flexible body 172 is shown in a completely drained position in which all of the fluid and air have been evacuated from its interior and it abuts flush against the face of the mounting bracket. The biasing forces generated by the spring 182 causes the support 180 to be completely rotated to a flush position against the side of the mounting bracket and provides a space saving convenience to the device.

A screw top support 186 is integrally formed with the mounting bracket 184 at a second higher position above the support 180 and supports the pump spray head in place after the contents of the body have been evacuated. The fastening head can be rotatably disattached from the screw top support and a fluid supply can be provided to refill the device, causing the body to resume its original and filled shape and the support 180 rotated back to its original outwardly biases position.

The mounting bracket 184 of the sixth preferred embodiment is generally larger as opposed to the earlier embodiments for the specific purpose of separately supporting the pump spray head and the lower pivotal support. A first inwardly directed prong 188 and a second inwardly directed prong 190 are provided for mounting the bracket to the rear face of the fan as previously described.

Finally, referring to FIGS. 14 and 15 a portable misting device and fan 194 is shown according to a seventh preferred embodiment of the present invention. The misting device includes a body 196 which is shaped substantially identical to that shown in the embodiment of FIGS. 10 and 11 and includes a body with a forwardly angles midsection terminating in a spray pump head 198 which is tilted in a direction forwardly and downwardly in front of the fan blade unit of the portable fan. The midsection of the misting device body includes a pair of inwardly recessed sidewalls 200 as shown from the cross section of FIG. 15 which terminates in a central point 202.

The embodiment of FIGS. 14 and 15 replaces the mounting bracket shown in the earlier embodiments in that a first upper barbed prong 204 and a second lower barbed prong 206 are integrally formed with and extend forwardly from the body of the misting device. The barbed prongs insert within the apertures formed in the rear face of the fan body as previously disclosed. Accordingly, the barbed prongs replace the mounting bracket and provide a direct connection between the misting device and the fan unit.

The present invention therefore teaches a novel and useful portable misting device and fan which is an improvement over other misting devices and which is portable and highly effective for use by individuals participating in athletic or other outdoor activities. The present invention also provides a combination portable fan and misting device which may be used separably or in combination as desired by the user.

Having described our invention, additional embodiments will become apparent to those skilled in the art to which it pertains. Specifically, other misting bottle shapes and sizes may be employed with the fan, provided the necessary mounting bracketry is provided for attaching the misting device to the fan. Other types of fasteners may be provided for attaching the misting device to the spray applicator, such as pressure fit elements for inserting into the body outlet of the device or overtravel clamps for securing around a neck of the body. Other kinds of spray applicators may alternatively be used with the misting device. The fan may also be shaped as desired to correspond with an appropriately shaped misting device.

We claim:

1. A spray misting device for use with a portable fan for creating a cooling atomized mist spray, the fan having a predetermined outline and thickness with a front and a rear and enclosing a fan blade unit between a front grille and a rear grille, said spray misting device comprising:

a body of given dimension having a hollow interior capable of holding a predetermined volume of a liquid and an applicator for providing an atomized mist spray of said liquid;

means for releasably securing said body to the rear of the fan so that said body is positioned behind the fan and said applicator is positioned at a point above the fan blade unit; and means for actuating said applicator to issue said mist spray from above and in a direction towards a front of the fan blade unit;

whereby the fan blade unit generates a current of air which cools said atomized mist spray and delivers said spray to a user thereof.

2. The spray misting device for use with a portable fan as described in claim 1, said means for releasably securing further comprising a first upper barbed prong and a second lower barbed prong extending from a forward surface of said body, said upper and lower barbed prongs inserting within associated recesses formed in the rear face of the fan.

3. The spray misting device for use with a portable fan as described in claim 1, said body further comprising a base, an ergonomically formed midsection extending upwardly from said base, and an outlet which is engaged by a screw cap.

4. The spray misting device for use with a portable fan as described in claim 3, said base has a forwardly extending portion upon which is supported a corresponding bottom surface of the fan.

5. The spray misting device for use with a portable fan as described in claim 3, said means for releasably securing comprising said mounting bracket having first and second rearwardly extending clip portions which are received within first and second grooves formed in the sides of said ergonomically formed midsection of said body.

6. The spray misting device for use with a portable fan as described in claim 3, said applicator having a spray applicator body integrally formed with said screw cap and said mounting bracket to mount said body to the fan.

7. The spray misting device for use with a portable fan as described in claim 6, further comprising a stem extending downwardly from said applicator body into said hollow interior of said misting device.

8. The spray misting device for use with a portable fan as described in claim 7, said means for actuating said applicator comprising a pump spray member extending from said applicator body and being actuable to draw fluid into said stem, through an internal channel in said applicator body and a flexible outlet tube extending from said applicator body, said outlet tube terminating in a nozzle mounted to the fan for delivering said misting and atomized spray.

9. The spray misting device for use with a portable fan as described in claim 8, said pump spray member comprising an elastic and internally hollowed pump spray ball.

10. The spray misting device for use with a portable fan as described in claim 8, further comprising a trigger which is hingedly mounted to said applicator body and which is engageable to biasingly contact and depress said pump spray member.

11. The spray misting device for use with a portable fan as described in claim 1, said means for releasably securing further comprising a mounting bracket integrally formed with said body and including a pair of forwardly extending prongs which are received within a pair of associated recesses in the rear of the fan.

12. The spray misting device for use with a portable fan as described in claim 11, further comprising an aperture formed in said mounting bracket for receiving a lanyard loop for mounting the portable device and fan around a neck of a user.

13. The spray misting device for use with a portable fan as described in claim 11, further comprising a piston pump head which is mounted atop said body, said pump head including an atomized spray outlet which is depressible in a direction toward said applicator body through a connecting shaft.

14. The spray misting device for use with a portable fan as described in claim 13, said body includes a base and a forwardly curved midsection terminating in an outlet upon which is mounted said piston pump head, said curved midsection includes inwardly recessed sides at a forward end, a spring clip attached at said forward end connects to said mounting bracket so that said pump spray applicator issues a pump spray in a direction downwardly and in front of the fan blade unit of the fan.

15. The spray misting device for use with a portable fan as described in claim 13, said body being constructed of a flexible material which collapses against said mounting bracket upon evacuation of said liquid.

16. The spray misting device for use with a portable fan as described in claim 15, further comprising a sealing collar extending from said mounting bracket at an upper end thereof for supporting said piston pump head, a reservoir support extending from said mounting bracket at a lower end for supporting said collapsible body.

17. The spray misting device for use with a portable fan as described in claim 16, said lower support being spring loaded to progressively biasingly engage said collapsible body and to rotate to a flush position against the face of said mounting bracket upon evacuation of the contents of said collapsible body.

18. A combination spray misting device and portable fan for creating a cooled atomized mist spray, comprising:

said fan having an outline with a front and a rear separated by a predetermined thickness, a fan blade unit being contained within said fan;

said misting device having a body containing a volume of a liquid and an applicator means including a nozzle for supplying said liquid in an atomized mist spray; and releasably securing means for mounting said misting device to said rear of said fan so that said nozzle is positioned above said fan blade unit and provides said atomized mist spray in a direction in front of said fan blade unit;

whereby said atomized mist spray is cooled and distributed to a user by air currents generated by said fan blade unit.

* * * * *